US008944174B2

(12) United States Patent
Thomas et al.

(10) Patent No.: US 8,944,174 B2
(45) Date of Patent: Feb. 3, 2015

(54) SPRAY HEAD

(75) Inventors: Paul Thomas, London (GB); Yusuf Muhammad, Kent (GB); Jeung Woo-Choi, Ho (KR)

(73) Assignee: Plumis Limited, London (GB)

( * ) Notice: Subject to any disclaimer, the term of this patent is extended or adjusted under 35 U.S.C. 154(b) by 861 days.

(21) Appl. No.: 13/130,523

(22) PCT Filed: Nov. 20, 2009

(86) PCT No.: PCT/GB2009/002727

§ 371 (c)(1),
(2), (4) Date: Aug. 5, 2011

(87) PCT Pub. No.: WO2010/058183

PCT Pub. Date: May 27, 2010

(65) Prior Publication Data

US 2011/0284250 A1 Nov. 24, 2011

(30) Foreign Application Priority Data

Nov. 21, 2008 (GB) ..... 0821388.6

(51) Int. Cl.

| | |
|---|---|
| ***A62C 3/00*** | (2006.01) |
| ***A62C 37/10*** | (2006.01) |
| ***A62C 37/36*** | (2006.01) |
| ***A62C 35/02*** | (2006.01) |
| ***A62C 35/58*** | (2006.01) |
| ***E03C 1/04*** | (2006.01) |

(52) U.S. Cl.

CPC . *A62C 3/00* (2013.01); *A62C 3/006* (2013.01); *A62C 35/026* (2013.01); *A62C 35/58* (2013.01); *A62C 37/36* (2013.01); *E03C 1/04* (2013.01)

USPC ..... 169/46; 169/54; 169/60; 169/61; 169/65

(58) Field of Classification Search

USPC ..... 169/46, 47, 54, 56, 60, 61, 65

See application file for complete search history.

(56) References Cited

U.S. PATENT DOCUMENTS

| | | | |
|---|---|---|---|
| 179,975 | A | 7/1876 | Trembley |
| 4,356,870 | A | 11/1982 | Gaylord et al. |
| 4,429,931 | A | 2/1984 | Brooks |
| 4,557,289 | A | 12/1985 | Kasnick |
| 5,890,631 | A | 4/1999 | Spurlock et al. |

(Continued)

FOREIGN PATENT DOCUMENTS

| | | | |
|---|---|---|---|
| AU | 698 899 | B2 | 11/1998 |
| GB | 2 391 807 | A | 2/2004 |

(Continued)

OTHER PUBLICATIONS

Decision of Rejection issued in corresponding Chinese Application No. 200980151850.9; Dated Jun. 8, 2013 (4 pages).

(Continued)

*Primary Examiner* — Darren W Gorman

(74) *Attorney, Agent, or Firm* — Osha Liang LLP

(57) ABSTRACT

A fire suppression spray head for attaching to a sink assembly comprising a sink, a tap, a work surface adjacent the sink, a cupboard underneath the sink and at least one cupboard door, the spray head having at least one nozzle for spraying fire suppressant material received from a supply of fire suppressant material, wherein the spray head is configured to be attached to a part of the sink assembly.

19 Claims, 17 Drawing Sheets

(56) References Cited

U.S. PATENT DOCUMENTS

| | | | | |
|---|---|---|---|---|
| 6,044,913 | A * | 4/2000 | Stehling et al. | 169/65 |
| 6,394,124 | B1 * | 5/2002 | Wu | 137/119.04 |
| 7,017,600 | B2 | 3/2006 | Klein | |
| 2002/0005288 | A1 | 1/2002 | Haase, III | |
| 2003/0010509 | A1 | 1/2003 | Hoffman | |
| 2007/0193753 | A1 * | 8/2007 | Adiga et al. | 169/45 |
| 2009/0272372 | A1 * | 11/2009 | Griffin et al. | 126/299 E |

FOREIGN PATENT DOCUMENTS

| | | | |
|---|---|---|---|
| JP | 2000-140144 | A | 5/2000 |
| JP | 2004-173993 | A | 6/2004 |
| JP | 2008-111237 | A | 5/2008 |
| WO | 00/61235 | A1 | 10/2000 |
| WO | 2008/041867 | A2 | 4/2008 |
| WO | 2008125416 | A1 | 10/2008 |

OTHER PUBLICATIONS

Third Office Action and Search Report issued in corresponding Chinese Application No. 200980151850.9; Dated Dec. 28, 2012 (8 pages).

EPO Communication—Third Party Observation for European Application No. 09760273.4; Dated Jul. 23, 2012 (15 pages).

Patent Abstracts of Japan, Publication No. 2000-140144, dated May 23, 2000, 1 page.

International Search Report issued in PCT/GB2009/002727, mailed on Jan. 15, 2010, 3 pages.

Written Opinion issued in PCT/GB2009/002727, mailed on Jan. 15, 2010, 4 pages.

Search Report issued in parent application GB0821388.6, dated Mar. 19, 2009, 5 pages.

Notice of Grant issued in corresponding Chinese Application No. 200980151850.9 dated May 28, 2014 (4 pages).

Examination Report issued in corresponding Australian Application No. 2009316975; Dated Apr. 4, 2014 (5 pages).

* cited by examiner

SPRAY HEAD

TECHNICAL FIELD

The present invention relates to a spray head, in particular a fire suppression spray head comprising at least one nozzle through which fire suppressant material (such as water) can be sprayed.

BACKGROUND

Fire suppression systems which use nozzles are known. For example, U.S. Pat. No. 4,356,870 describes a water spray fire protection system for hoods over cooking units which comprises spray nozzles on the lower ends of water pipes which are connected to a water supply pipe. A disadvantage of such systems is that they are relatively complex and therefore relatively expensive to install.

The present invention is made with this in mind.

SUMMARY

In one aspect, the present invention provides a fire suppression spray head for attaching to a sink assembly comprising a sink, a tap, a work surface adjacent the sink, a cupboard underneath the sink and at least one cupboard door. The spray head has at least one nozzle for spraying fire suppressant material received from a supply of fire suppressant material. The spray head is configured to be attached to a part of the sink assembly.

In another aspect, the present invention provides a fire suppression spray head for attaching to a work surface. The spray head has at least one nozzle for spraying fire suppressant material received from a supply of fire suppressant material. The spray head is configured to be attached to the work surface.

By the spray head being configured to be attached to a part of the sink assembly or work surface, the spray head can be easily and simply installed with a relatively small amount of additional piping. For example, the spray head can be simply connected to an existing water supply pipe under the sink or for a washing machine. Furthermore, the spray head can be retro-fitted to existing sink assemblies. Accordingly, a relatively inexpensive and/or unobtrusive fire suppression solution can be provided.

Other aspects of the present invention will be appreciated from the following description and accompanying claims.

BRIEF DESCRIPTION OF THE DRAWINGS

Embodiments of the present invention will now be described, by way of example only, with reference to the accompanying drawings in which like reference numerals are used to depict like parts. In the drawings.

DETAILED DESCRIPTION

Figure 1:
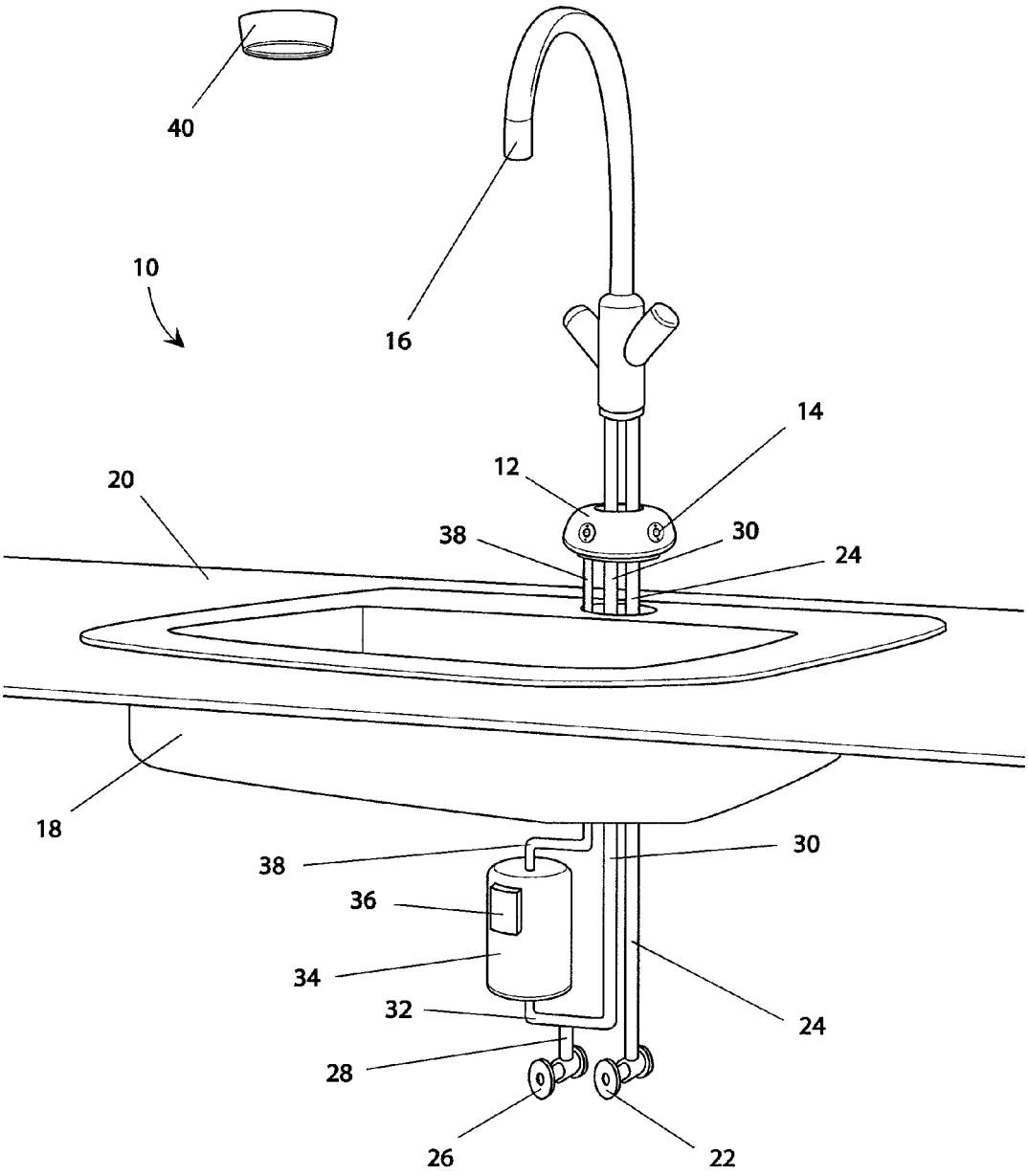
FIG. 1 is a partially exploded illustration of an embodiment of a spray head attached to the base of a tap.

In the present disclosure the term "fire suppression" is used to encompass other terms which may be used when describing suppressing, controlling or extinguishing fires. In particular "fire suppression" is used to encompass the terms "fire suppression", "fire control" and "fire extinguishment", although for the purposes of the present disclosure these terms can be used interchangeably unless a specific instance indicates otherwise. The term "sink" is used to encompass both "sinks" and "basins", and indeed these terms can be used interchangeably. Similarly, the term "tap" is used to encompass both "taps" and "faucets" and again these terms can be used interchangeably.

In some applications, "fire control" is used to describe a steady reduction in the heat release rate resulting in a lower controlled level of burning/limitation of fire growth and protection of structure (by cooling of objects, fire gases and/or pre-wetting adjacent combustibles) and "fire extinguishment" is used to describe a sharp reduction in heat release rate leading to complete elimination of any flaming or smoldering fire. The spray head of the present disclosure can be used in these applications.

In describing the arrangements shown in the figures, where the same reference numeral has been used to describe the same part in an earlier figure, the part will not be described again although it should be appreciated that the relevant earlier description applies, where appropriate.

Referring to the Figures, FIG. 1 shows a sink assembly 10 comprising a sink 18, a tap 16 and a work surface 20 adjacent the sink. A fire suppression spray head 12 with at least one nozzle 14 is attachable to the sink 18 at the base of the tap 16. The spray head 12 can be considered as comprising a housing 12 having at least one nozzle 14.

Underneath the sink, a pressure generator, in this example a pump 34, is connected through pipe or hose 38 to the nozzles 14 of the spray head. The pump 34 is also connected through pipe or hoses 28, 32 to the cold water supply 26. Accordingly, pump 34 is activatable to supply fire suppressant material (in this example water) to the nozzles 14 of the spray head 12.

Cold water supply 26 is also connected through pipe 30 to the tap to provide cold water. Hot water supply 22 is connected to the tap 16 through pipe 24 to provide hot water.

Spray head 12 has a central aperture through which pipes 24 and 40 can pass. The spray head sits around or surrounds the base of the tap 16.

Fire suppression and/or initiation device(s) are provided in the form of detector 40 and pump control 36. The detector 40 comprises a transmitter and the pump control comprises a receiver. Detector 40 is arranged to detect a fire and in response transmit via the transmitter a signal to the pump control 36. In response to receiving via its receiver the signal the control 36 is arranged to activate the pump and supply water from water supply 26 to the nozzles 14. Water is sprayed out of nozzles 14 to suppress or control or extinguish the fire.

Figure 2:
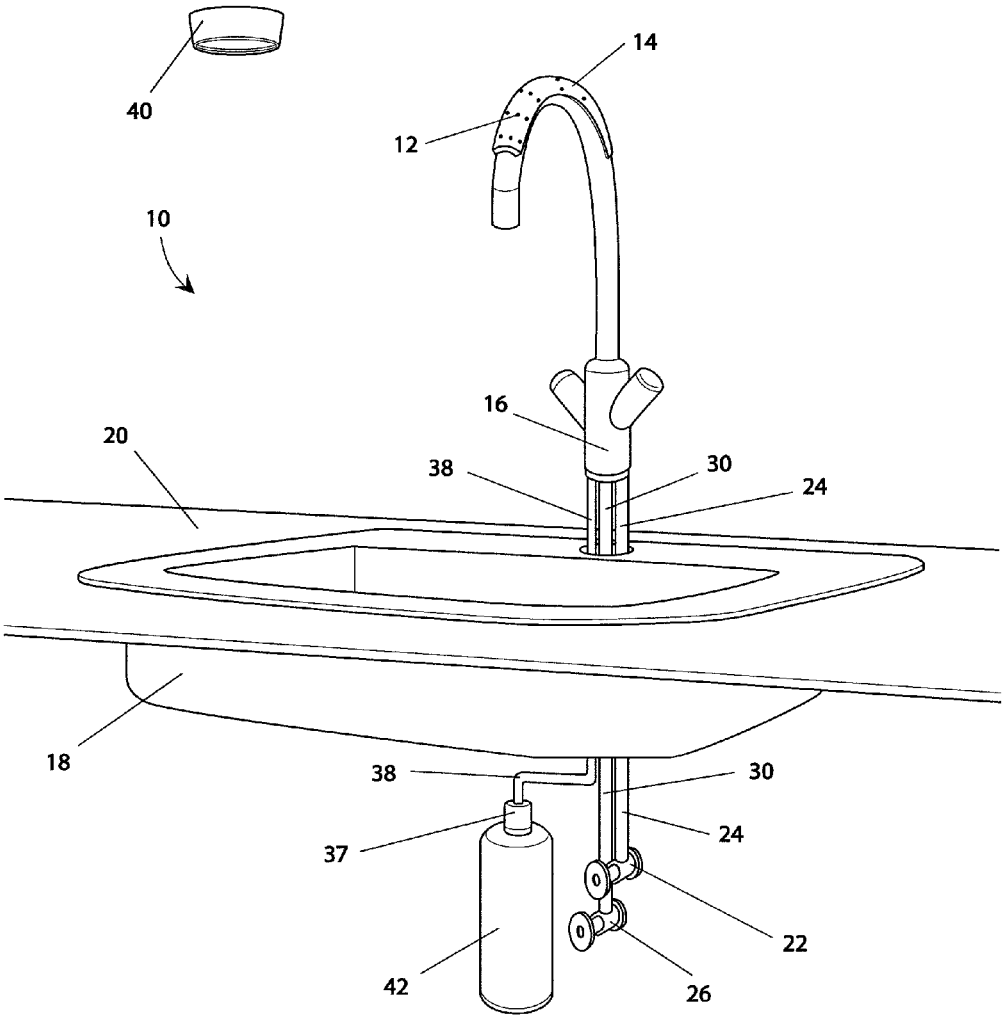
FIG. 2 is a partially exploded illustration of an embodiment of a spray head attached to a tap.

Referring now to FIG. 2, sink assembly 10 comprising a sink 18 and a tap 16 is shown. Spray head 12 is attached to the tap 16. The spray head 12 comprises a plurality of nozzles 14. Nozzles 14 in this arrangement are air or pneumatic atomising nozzles.

Air or pneumatic atomising nozzles are available from Lechler Ltd., 1 Fell Street, Newhall, Sheffield, South Yorkshire S9 2TP. FIG. 8*c*, described later, illustrates an example of an air/pneumatic atomising nozzle.

In the arrangement of FIG. 2, a fire suppressant material such as Argonite, FM 200, HFC 227ea, Inergen and $CO_2$ is provided in a compressed gas cylinder 42. The compressed gas cylinder is connected to the nozzles of spray head 12 through pipe or hose 38. An electric valve 37 is activatable to supply the fire suppressant material to the nozzles 14 of the spray head 12. Suitably, the electric valve can be connected to a receiver (not shown) and can be activated in the same way as described in relation to the arrangement of FIG. 1.

Figure 3:
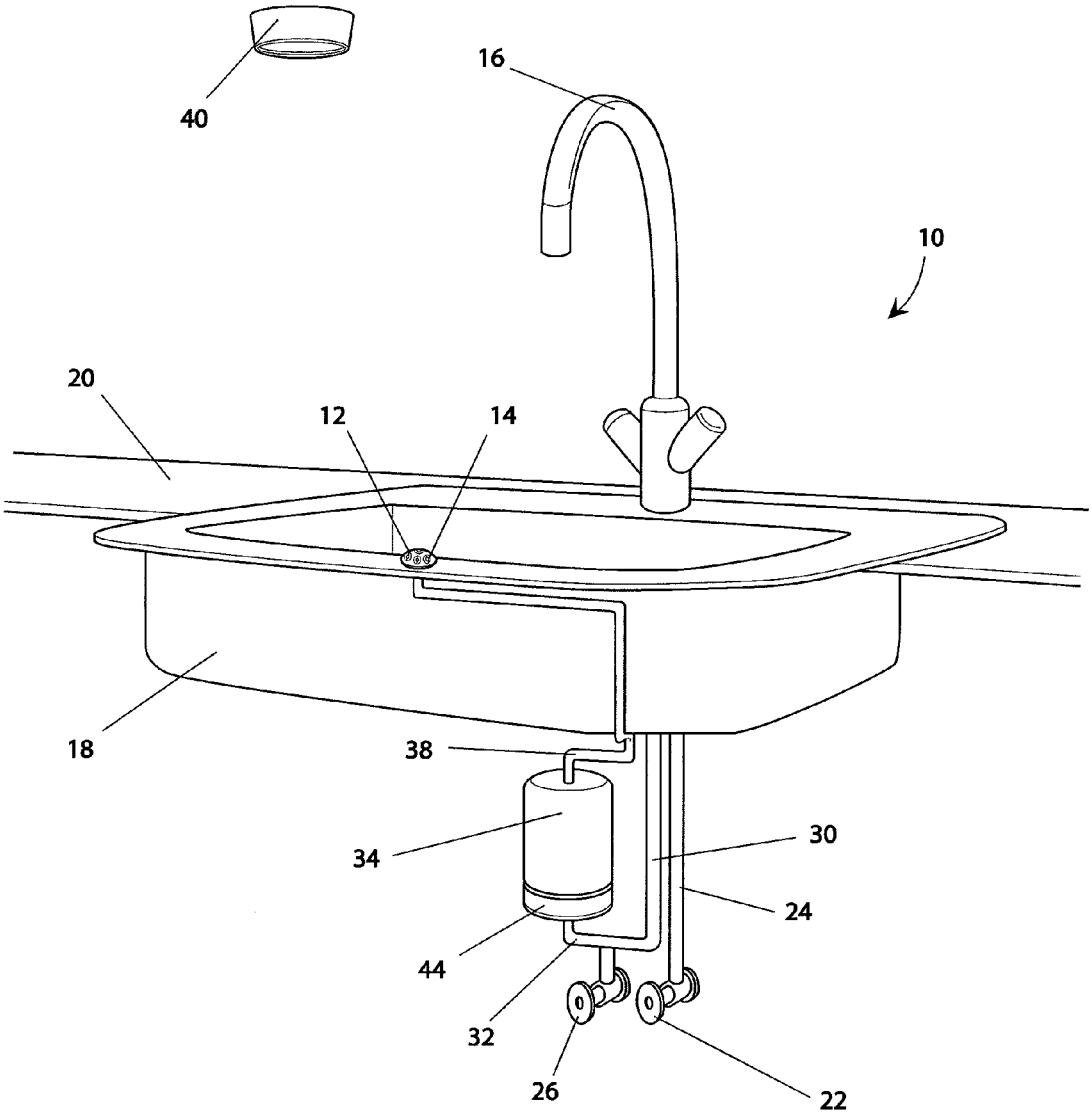
FIG. 3 illustrates an embodiment of a spray head attached to the front of a sink.

Referring now to FIG. 3, a sink assembly 10 comprising a sink 18 and a tap 16 is shown. A spray head 12 with nozzles 14 is shown attached to the front of a sink through a hole which is often provided as one of two holes in sinks where the sink has a drainer section (not shown) which can be fitted on the left or the right of the sink to the customer's preference, and therefore depending on the side which is chosen for the drainer may have the tap fitted through one or other of two holes provided in the sink. This arrangement may use the hole which when installed is at the front of the sink i.e. which is not used for the tap. Alternatively, a dedicated hole may be formed.

Pump 34 has a water filter 44 to filter the water received from water supply 26. Pipe or hose 38 connects the pump to the nozzles 14 of the spray head 12 at the front of the sink.

Figure 4:
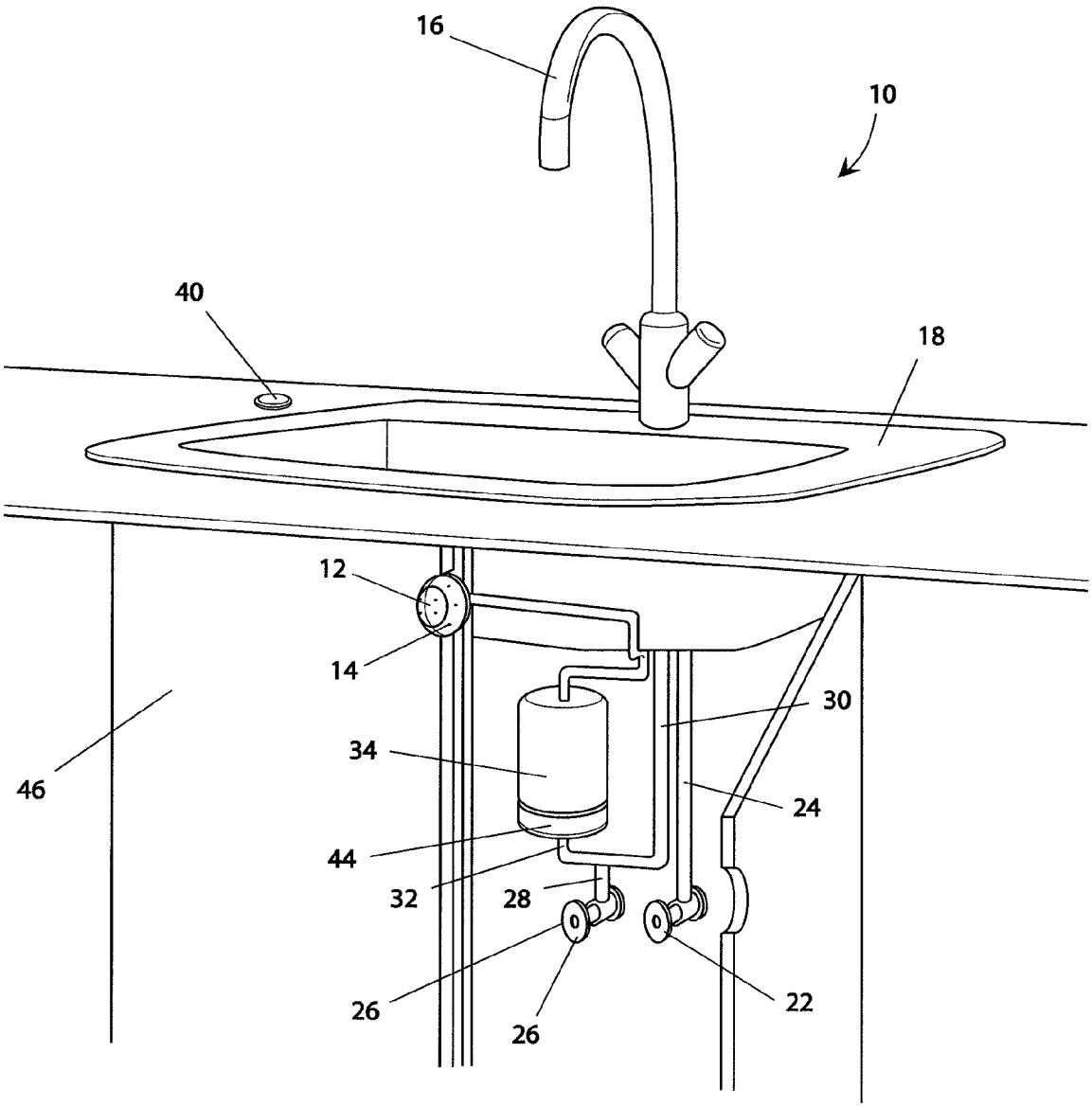
FIG. 4 illustrates an embodiment of a spray head attached to part of a cupboard.

Referring now to FIG. 4, sink assembly 10 comprising a sink 18, a tap 16 and a cupboard under the sink is shown. Spray head 12 with nozzles 14 is shown attached to part of the cupboard. The spray head 12 is attached to the upright of the wooden frame which supports the work surface and protruding through a cutaway portion of the cupboard door. Pipe or hose 38 connects the pump to the nozzles 14 of the spray head 12 on the door. A manual activation switch or button 40 is provided on the work surface which can be used to activate the pump so that water is sprayed out of nozzles 14 to suppress, extinguish or control a fire. This arrangement can be used alone or in combination with an automated arrangement using a detector 40 as described earlier.

Figure 5:
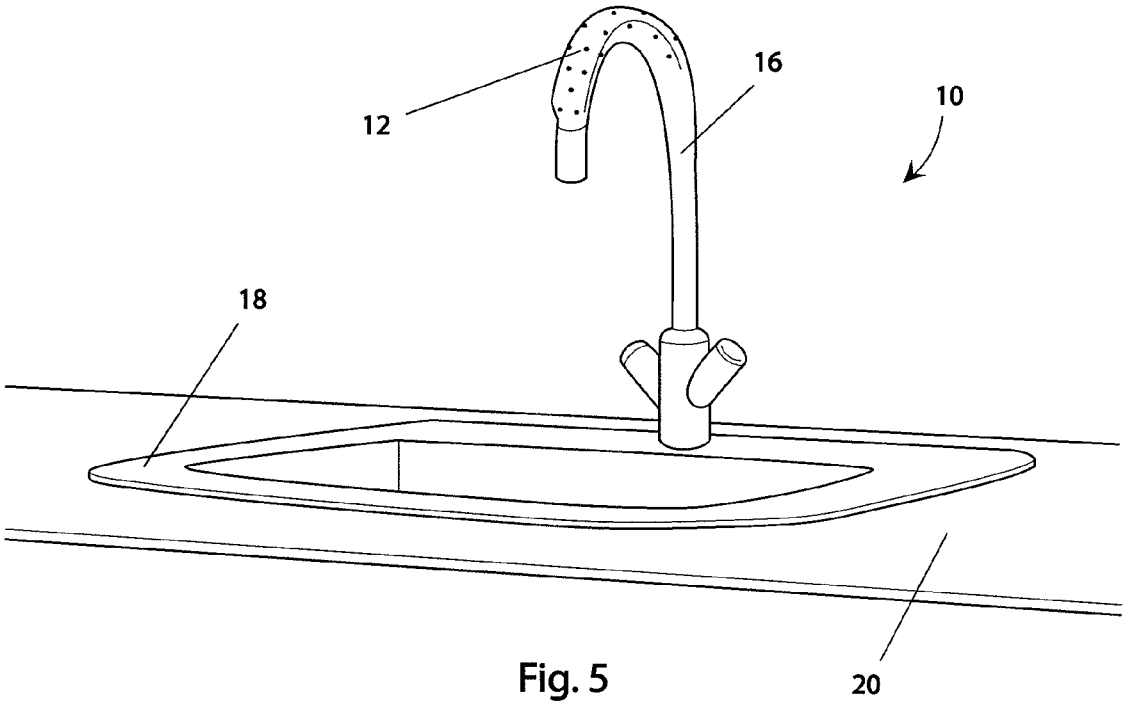
FIG. 5 illustrates an embodiment of a spray head which is an integral part of a tap.

FIG. 5 shows a spray head 12 which is integral with a tap 16 as part of a sink assembly 10 comprising a sink 18 and a tap 16. Spray head 12 comprises nozzles, illustrated as dots in the figure.

Figure 6:
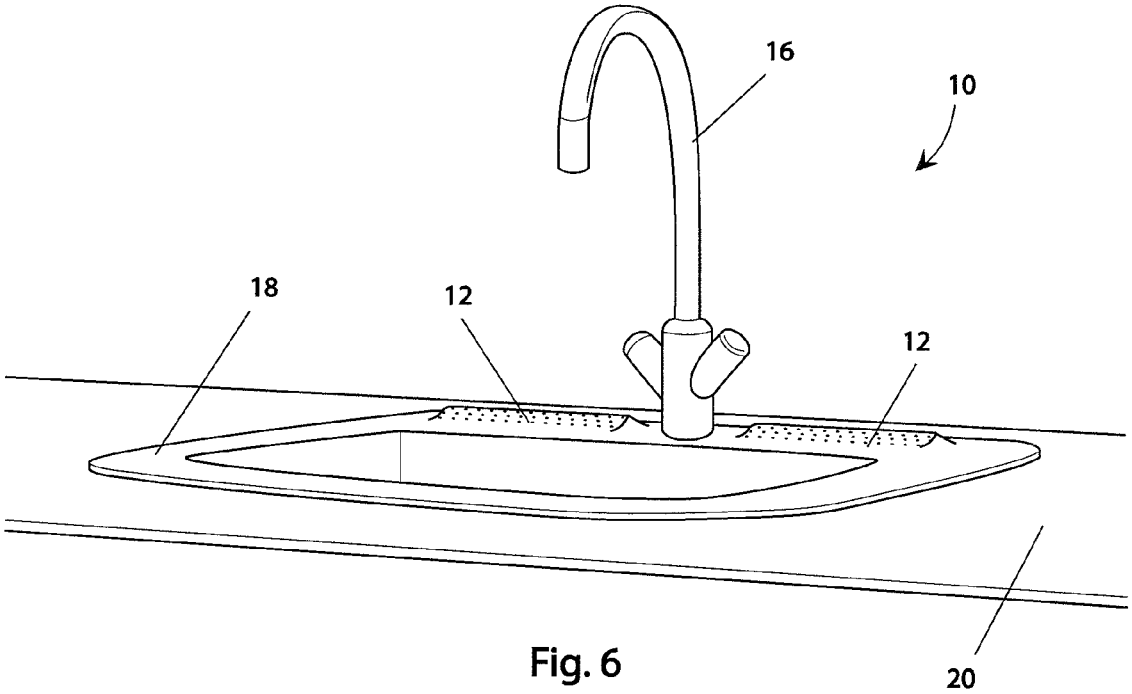
FIG. 6 illustrates an embodiment of a spray head which is an integral part of a sink.

FIG. 6 shows two spray heads 12 which are integral with a sink 18 as part of a sink assembly 10 comprising a sink 18 and a tap 16. Spray head 12 comprises nozzles, illustrated as dots in the figure.

In some arrangements, a plurality of nozzles is provided with an approximate orifice size of in a range of 0.152-1.02 mm. This can achieve a fog spray pattern with high percentage of droplets under 50 microns in size.

Figure 7A:
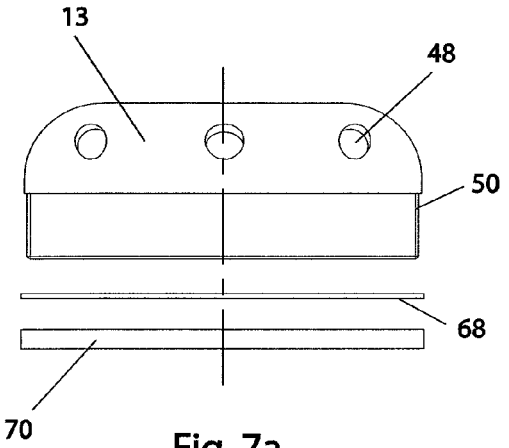
FIGS. 7*a*-7*c* and 8*a*-8*b* illustrate the structure of an embodiment of a spray head.
Figure 7B:
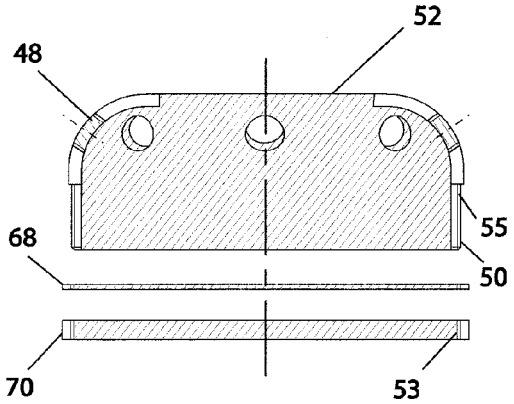
Figure 7C:
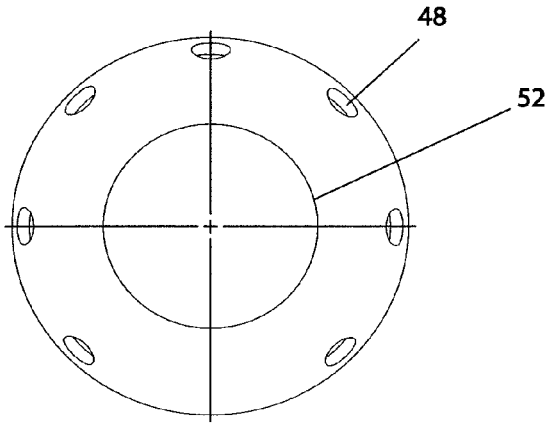

In FIG. 7*a*, the at least one nozzle is on a separate, attachable component. The figure illustrates a side view of a body or hub 13 of spray head 12. The hub 13 has apertures 48 for receiving micro nozzle components 52 (illustrated in FIG. 8*a*). FIG. 7*b* is a cross sectional view of the hub 13 of FIG. 7*a*. FIG. 7*c* shows a plan view of the hub 13. Referring to these figures, apertures 48 are provided with screw threads. A separate screw thread 50 is provided around the base of the hub and a threaded collar 70 having a complementary thread 53 is provided so that the collar 70 can be screwed to thread 50 to secure the spray head to a surface such as a sink. A washer 68 is provided which, when assembled, sits around the top of thread 50 between edge 55 of the spray head 12 (hub 13 with nozzle components attached) and a lower surface of the sink. The hub 13 also has an upper circular aperture 52 through which a tap can be connected, as described below with reference to FIG. 9.

In the illustrated example of FIG. 7*c* seven apertures are provided in seven of eight equally spaced positions. The eighth position does not contain an aperture and would typically be fitted facing the wall behind a sink.

Figure 8A:
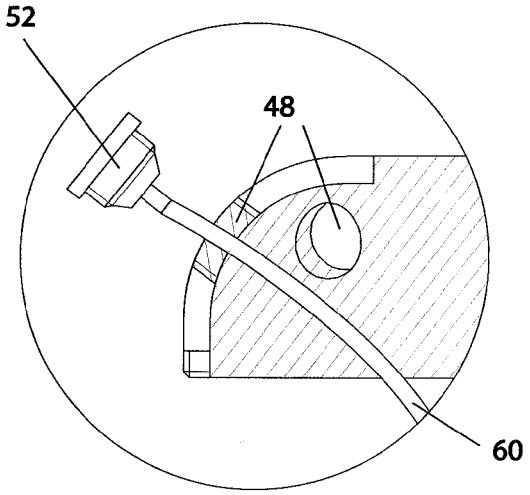

FIG. 8*a* shows a portion of hub 13 in a cross sectional view. Referring to FIG. 8*a*, micro nozzle components 52 are fitted (e.g. screwed in) to the apertures 48. Each micro nozzle component in this arrangement is a separate component, each having a plurality of nozzles/holes. Each micro nozzle component is attached to a high pressure tube 60, the other end of which is connectable to the pressure generator (e.g. pump or pressurised cylinder).

In a particular example, the micro nozzle component 52 produces a cone shaped fog spray pattern through a 90 degree spray pattern, with a high percentage of droplets under 50 microns in size. Suitable, micro nozzle components or micro nozzles are available from BETE Fog Nozzle, Inc. 50 Greenfield Street, Greenfield, Mass. 01301 USA (www.BETE-.com) and include the PJ misting nozzle range.

Figure 8B:
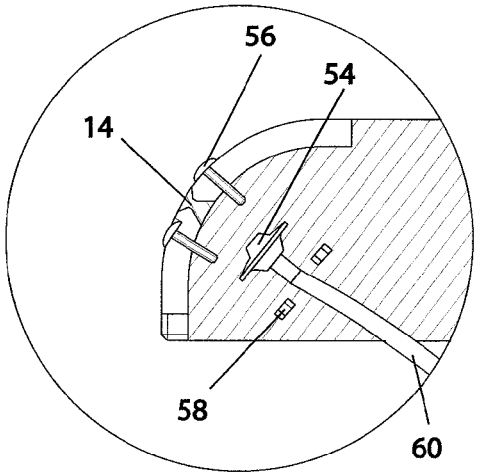
Figure 8C:
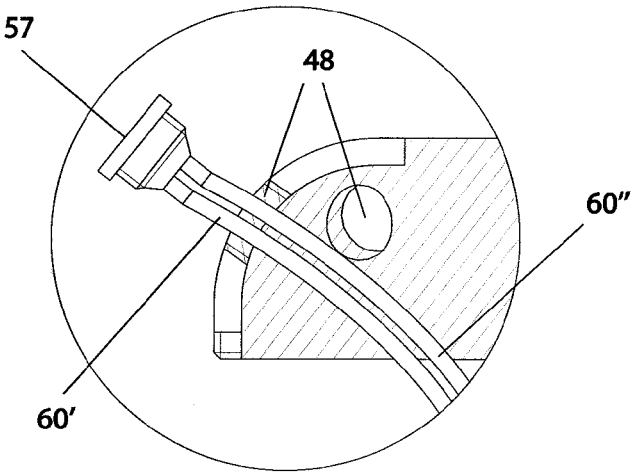

FIG. 8*b* shows an alternative arrangement with an hourglass shaped nozzle 14 in the hub. A high pressure coupling or nipple 54 connected to a high pressure hose is connectable to the nozzle 14. The other end of the high pressure tube is connectable to the pressure generator. The high pressure coupling is held in place by screws/bolts 56 and nuts 58.

FIG. 8*c* shows a pneumatic atomizing nozzle component 57 which has one hose 60' for supplying air and another tube 60" for supplying water. Varying the air and water pressures can achieve a range of spray patterns by changing the droplet size, degree of spray, distance and cone shape for example.

Figure 9:
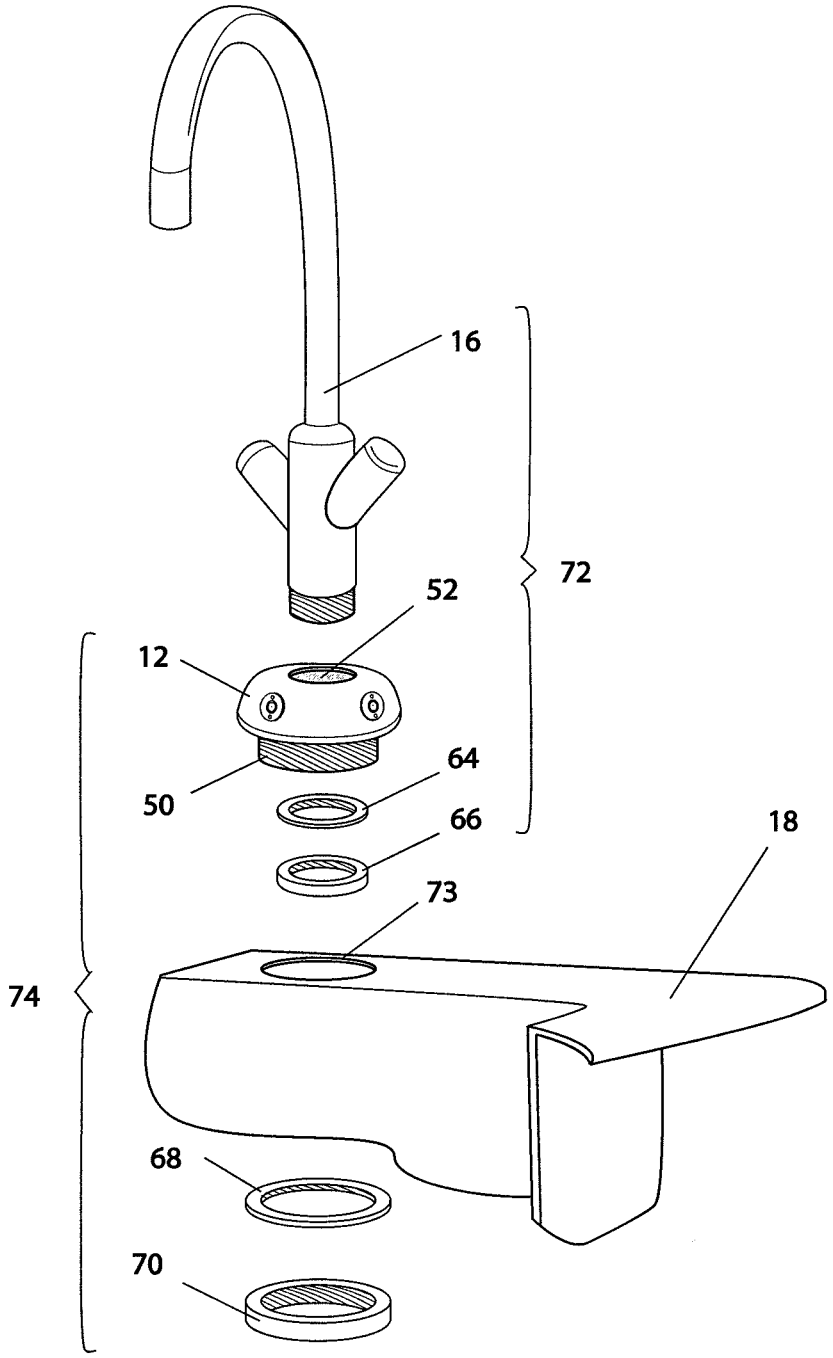
FIG. 9 is an exploded showing how an embodiment of a spray head is attached at the base of the tap.

FIG. 9 illustrates how the spray head 12 (for example the hub 13 of FIGS. 7*a*-7*c* with nozzle components attached) attaches to the base of a tap. The base of the spray head 12 fits into hole 73 in the sink and is fastened with threaded collar 70 (e.g. a brass collar). Washer 68 sits around the top of thread 50 between the lower surface of the sink and the collar 70. In a similar fashion, the base of tap 16 fits into aperture 52 of the spray head 12 and is fastened with threaded collar 66. Washer 64 sits around the top of thread of the base of the tap between the surface of the underside of the upper part of the spray head and the collar 66.

In FIG. 9 the tap and tap fixtures 72 comprise the tap 16, the washer 64 and the collar 66. The spray head and spray head fixtures comprise the spray head 12, the washer 68 and the collar 70.

Figure 10:
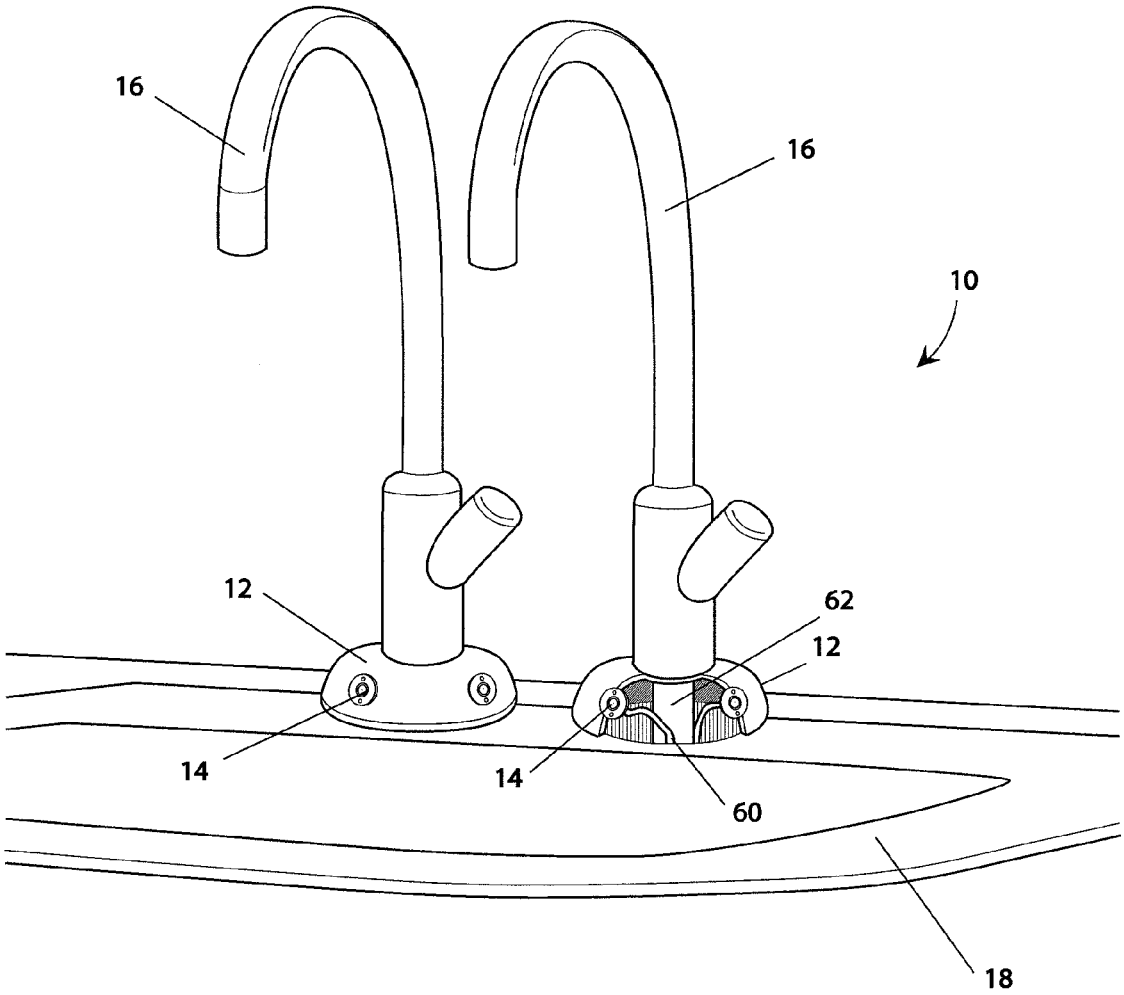
FIG. 10 illustrates a sink with separate hot and cold taps with an embodiment of a spray head attached to each tap.

FIG. 10 illustrates a sink assembly 10 comprising a sink and separate hot and cold taps 16, each with a respective spray head 12 at the base and having nozzles 14 such as those described in relation to FIG. 8*b*. The cutaway view of the right hand side tap shows water supply pipe 62 and high pressure hoses 60.

Figure 11:
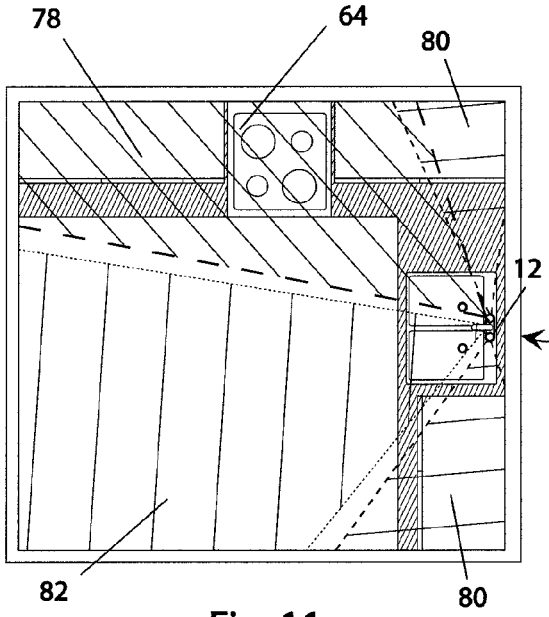
FIGS. 11-14 illustrate a configured spray pattern that can be achieved with embodiments of a spray head.
Figure 12:
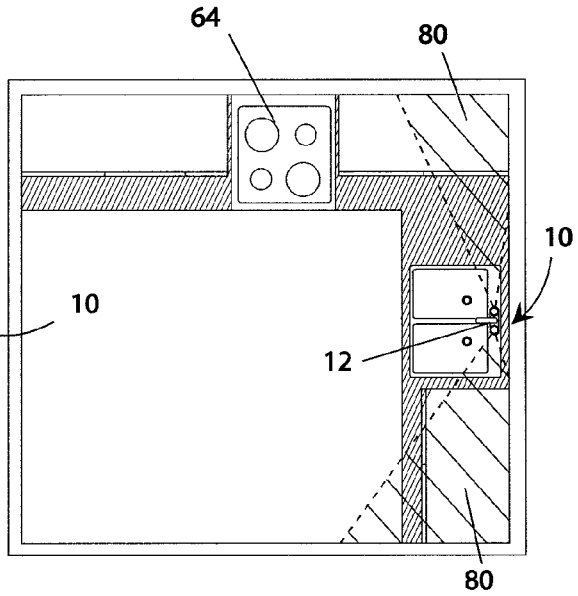
Figure 13:
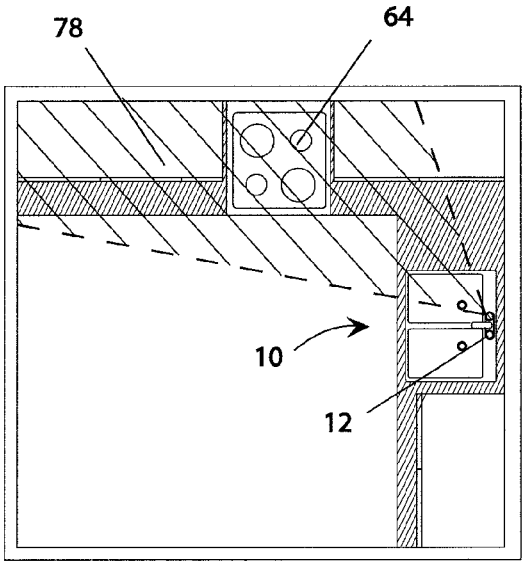
Figure 14:
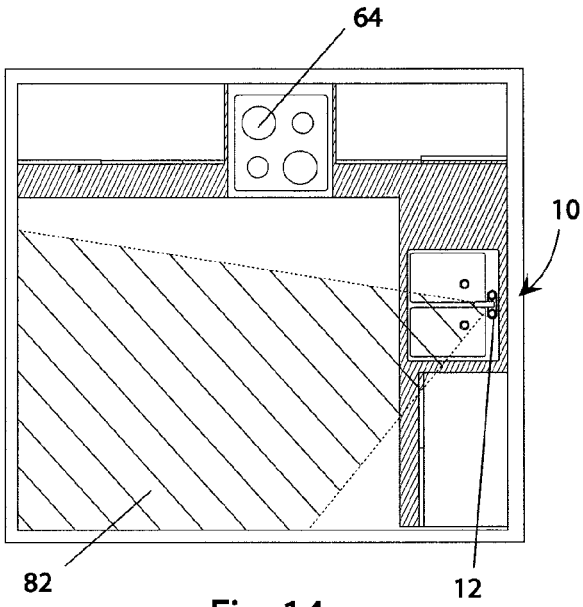

The spray head can be provided with nozzles of different sizes or types. That is, the spray head may be configurable so that a variety of separate, attachable components comprising the nozzles can be used with the same spray head and thus a variety of spray patterns can be achieved. Accordingly, the at least one nozzle can be configurable on installation so that the fire suppressant material can be directed towards the fire load. FIGS. 11-14 show how fire suppressant material (e.g. water) spray can be tailored to the fire load. FIG. 11 shows a configured spray pattern of primary, secondary and tertiary sprays with the primary spray directed towards the largest risk or fire load (the oven 64). The secondary spray is directed to the second largest risk or fire load, in this example the work surfaces and cupboards. The tertiary spray is directed to the third largest risk of fire load, in this example the room. The patterns of the primary spray pattern 78, secondary spray pattern 80 and tertiary spray patterns 82 are depicted in FIGS. 13, 12 and 14 respectively. The nozzles can be configurable, for example it may be the case that you want a larger droplet size to protect the oven 64 or perhaps a focused spray pattern. Adjusting the nozzle locations and specification allows you to vary the properties depending on the setup of the room and the mist (water characteristics) required to protect a given area.

Using pneumatic atomising nozzles provides one way of making the nozzles configurable. Another way in which one or more nozzles can be configurable on installation is by using different micro nozzle components such as the various different micro nozzles available from BETE Fog Nozzle, Inc.

Considerations when configuring the nozzles include selecting the droplet characteristics. For example, from an efficiency standpoint, the smaller the size of a droplet, the greater the surface area to volume ratio. The greater ratio translates to faster heat transfer and faster evaporation and results in energy being removed from the fire faster. As another example, a spiral nozzle design allows the largest droplets to migrate toward the outside of the pattern, thus providing protection to the smaller droplets allowing them to penetrate the target area.

Figure 15:
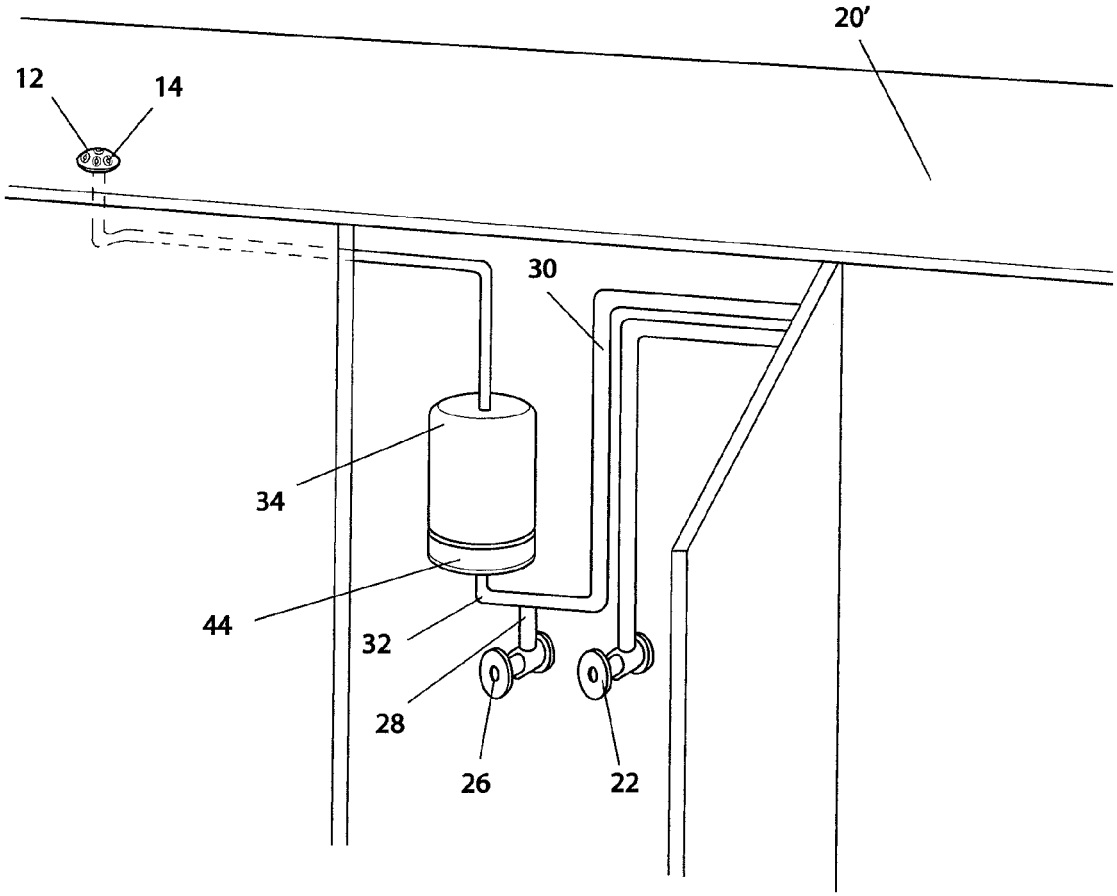
FIG. 15 illustrates an embodiment of a spray head which is attached to a work surface.

FIG. 15 illustrates a fire suppression spray head 12 attached to a work surface 20'. The work surface 20' can be an existing work surface above or in the proximity of an existing water supply for example a work surface above or in the proximity of a washing machine (not illustrated) or adjacent a sink (not illustrated). The spray head can be fitted to a work surface in a similar way to the way in which the spray head of FIG. 9 is fitted to the sink.

The spray head can be made from any suitable material such as stainless steel, a chrome plated brass or zinc alloy. In some cases it maybe porcelain to match the sink.

Figure 16A:
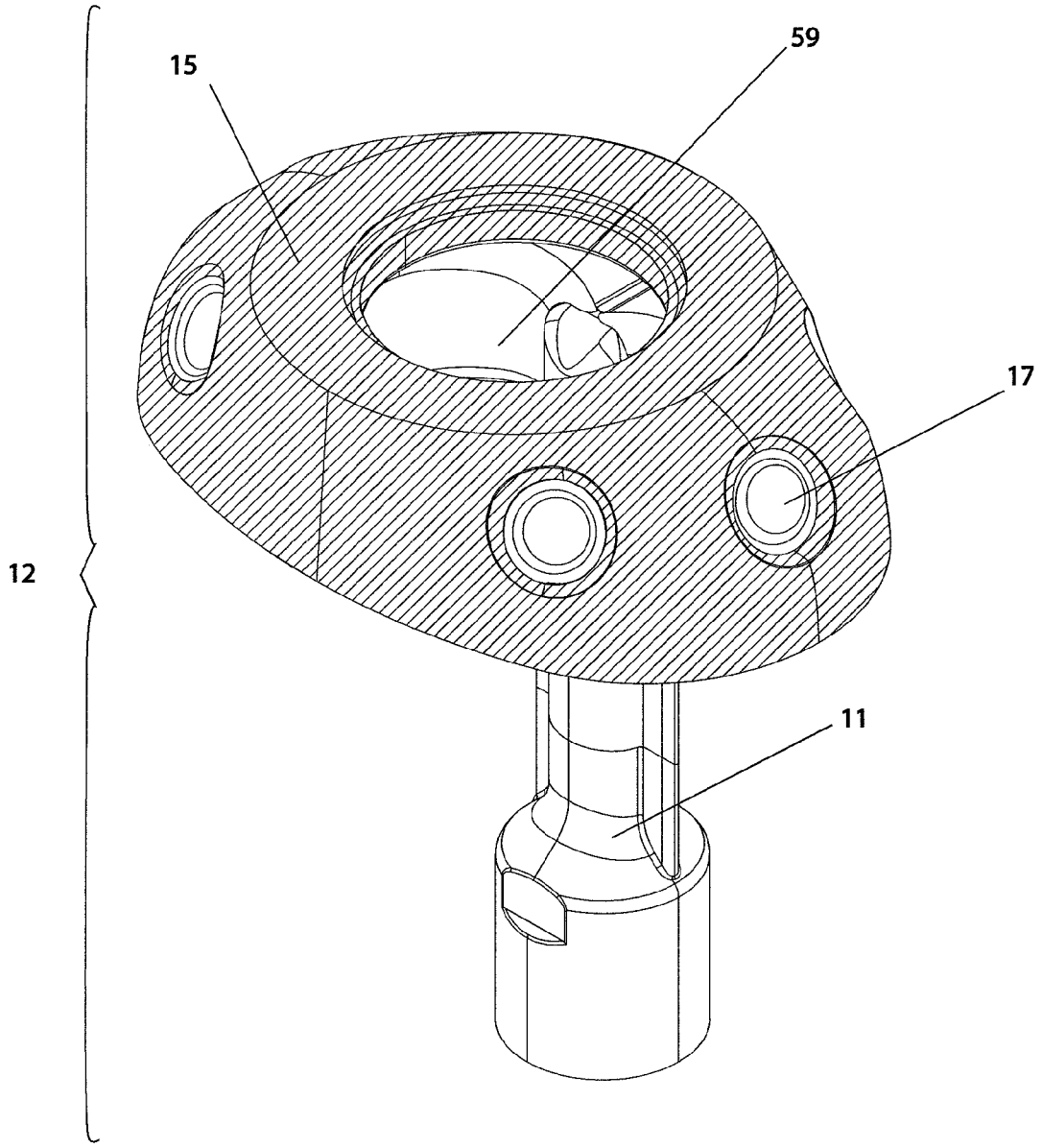
FIG. 16*a*-16*b* illustrates the structure of an embodiment of a spray head.
Figure 16B:
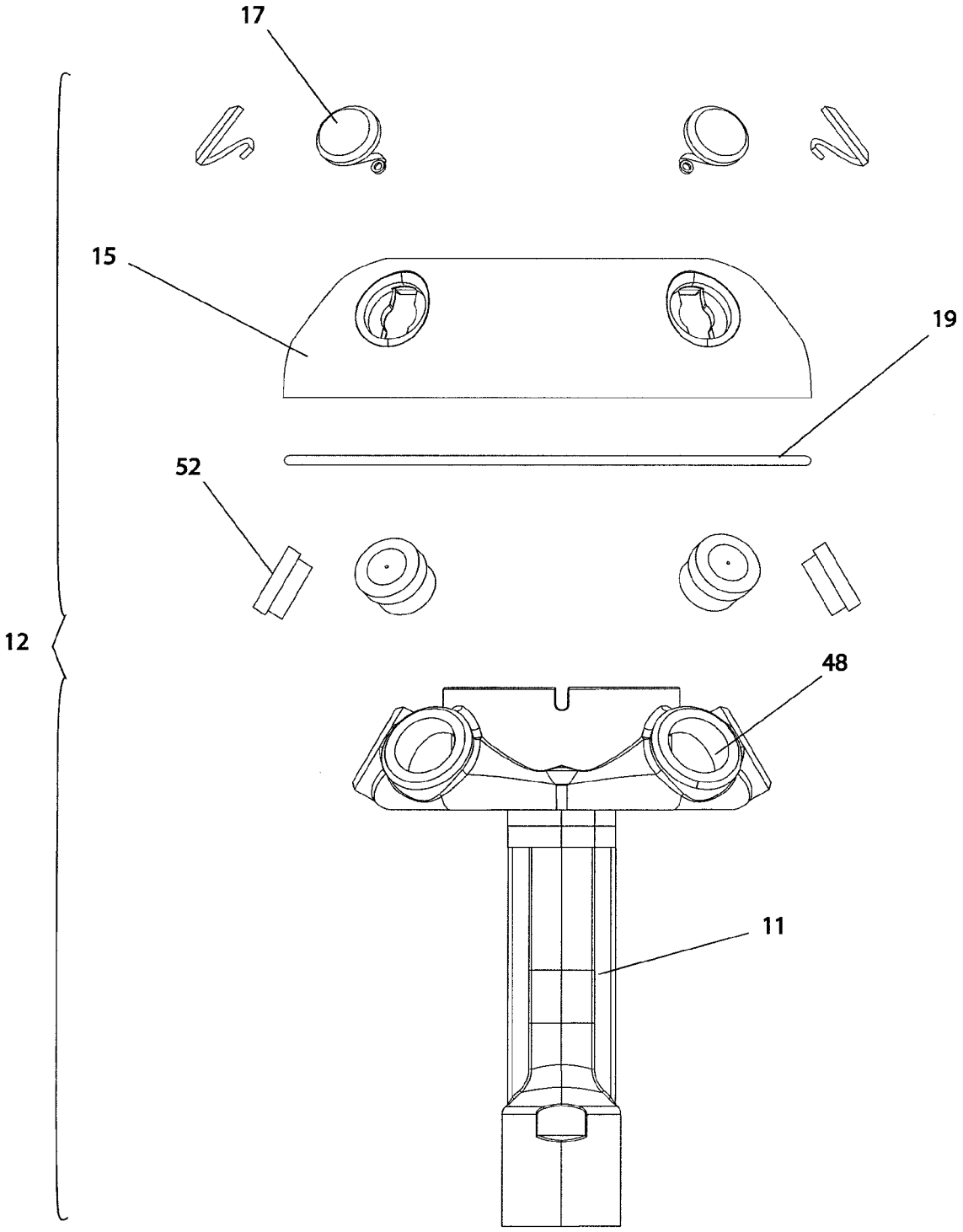

FIG. 16*a-b* shows an example of an embodiment of spray head 12. Spray head 12 has a central aperture 59 through which water supply pipes can pass. FIG. 16*a* shows the assembled spray head 12, consisting of the cover 15, manifold 11 and silicone caps 17 to protect the nozzles 52 (e.g. Danfoss-Semco A/S micro nozzles/jets). FIG. 16*b* shows an exploded side view of the spray head 12. The manifold 13 has apertures 48 for receiving micro nozzle components 52. An o-ring 19 is fitted into the lip 21 (illustrated in FIG. 18*b*) of cover 15 to form a seal between the sink 18 and the spray head 12 (illustrated in FIG. 19). The caps 17 are captive and pass though apertures in the cover 15. The caps are captive in that they open in response to the water spraying through the nozzles and still remain connected to the spray head (illustrated in FIG. 20). They also protect the nozzles from clogging by contaminants such as limescale or food particles, and are opened when the system is activated as water is sprayed from the nozzles.

Figure 17A:
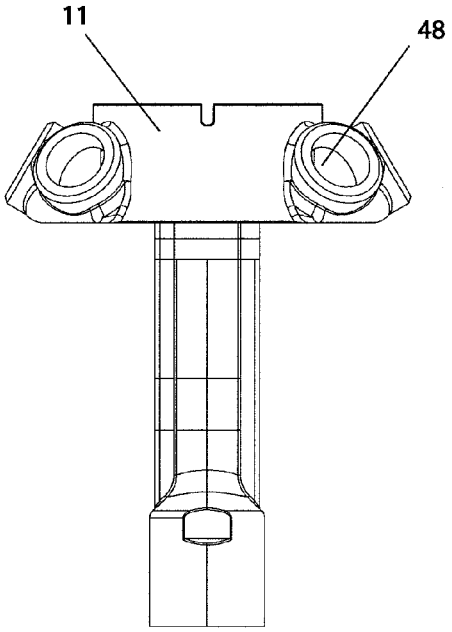
FIGS. 17*a*-17*d* and 18*a*-18*d* illustrate the manifold and cover which make up an embodiment of a spray head.
Figure 17B:
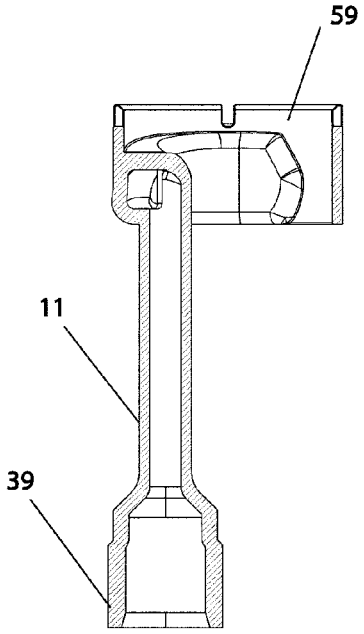
Figure 17C:
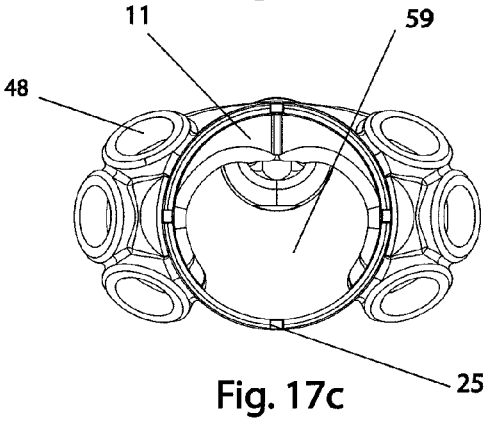
Figure 17D:
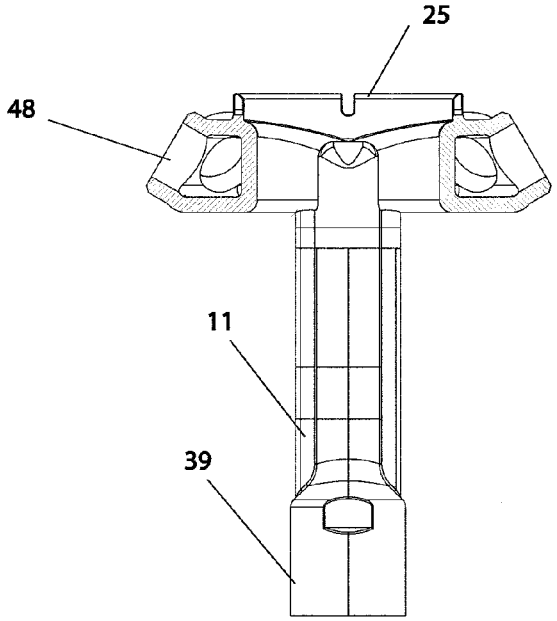

FIG. 17*a* shows a front view of the manifold 11. FIG. 17*b* shows a side view cross section of the manifold 11. FIG. 17*c* shows a plan view of the manifold 11. FIG. 17*d* shows a front view cross section of the manifold 11. Referring to FIG. 16*b*, micro nozzle components 52 are fitted (e.g. screwed in) to the apertures 48. Each micro nozzle component in this arrangement is a separate component, each having a plurality of nozzles/holes (although alternative embodiments are possible in which the nozzles are integral to the manifold). The manifold 11 can be considered as a pressure vessel that is arranged to distribute flow to the nozzles/holes. It also has location features 25 for mating with the cover 15 (illustrated in FIG. 18*a*-18*d*). The cover 15 can be changed to alter the appearance of the spray head without affecting the functionality. The manifold has a screw thread on the bottom end 39 for attaching a high pressure tube 38, the other end of which is connectable to the pressure generator (e.g. pump or pressurised cylinder).

Figure 18A:
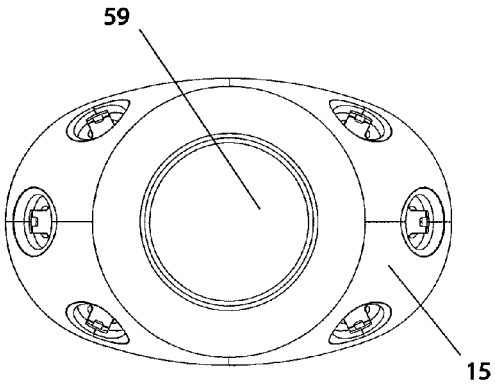
Figure 18B:
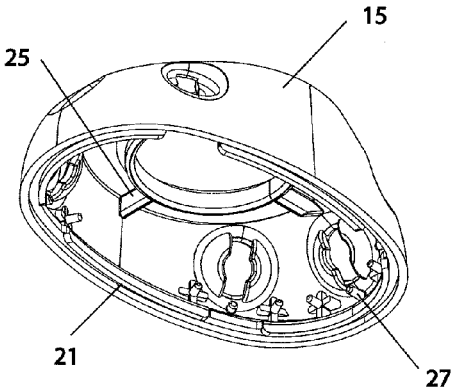
Figure 18C:
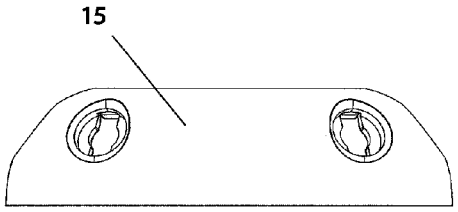
Figure 18D:
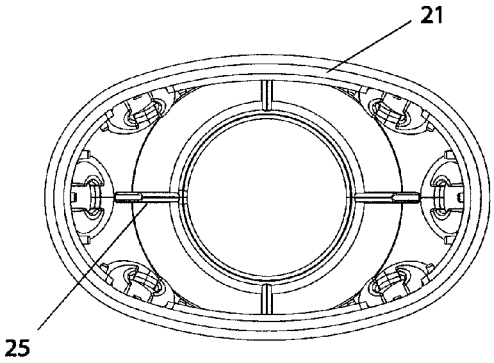

FIG. 18*a* shows a plan view the cover 15. FIG. 18*b* shows a perspective view of the cover 15. FIG. 18*c* shows a front view the cover 15. FIG. 18*d* shows a bottom view of the cover 15. A lip 21 runs around the bottom edge of the cover to locate an o-ring 19 (illustrated in FIG. 16*b*) to provide a watertight seal between the cover and the sink. Location pins 27 are situated on the inner side of the cover to prevent the silicone caps 17 (illustrated in FIG. 16*b*) from being ejected when the system is activated. The cover mates with the manifold using location features 25.

Figure 19:
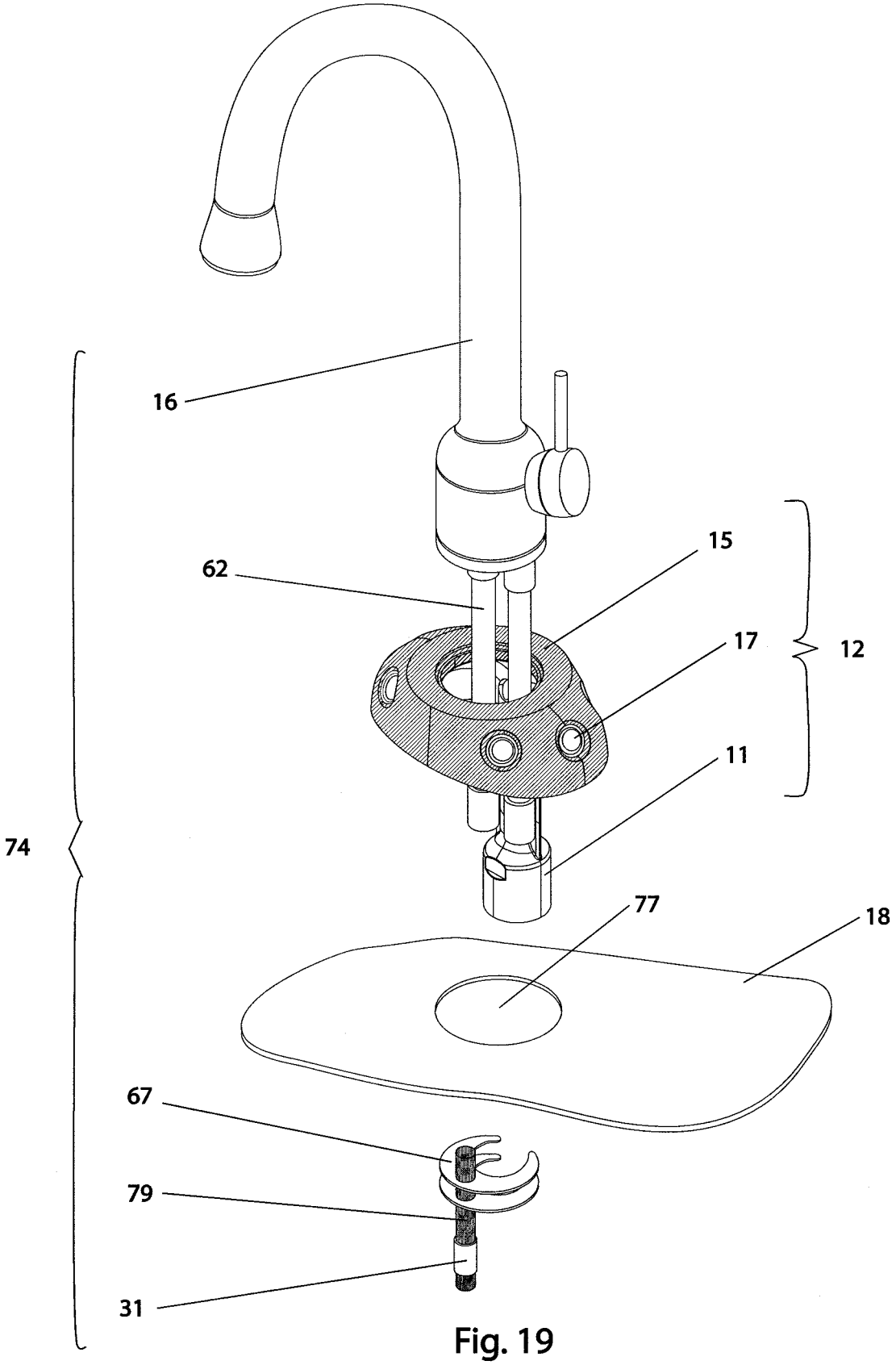
FIG. 19 is an exploded showing how an embodiment of a spray head is attached at the base of the tap.

FIG. 19 illustrates how the spray head 12 (for example of FIGS. 16*a*-16*b* with nozzle components attached) is arranged to attach to the base of a tap. The base of the spray head 12 fits into hole 77 in the sink. It is clamped in place with a nut 31 and threaded stud bar 79 (e.g. a brass bar) used to secure the tap. Washer 67 sits around the top of the threaded stud bar 79 between the lower surface of the sink and the nut 31.

In FIG. 19 the tap and tap fixtures 74 comprise the tap 16, the washers 67, threaded stud bar 79, the nut 31 and, hot and cold water supply pipes 62. The spray head 12 comprises the cover 15, manifold 11, o-ring 19, nozzles 58 and the caps 17 (illustrated in FIG. 16*b*).

Figure 20A:
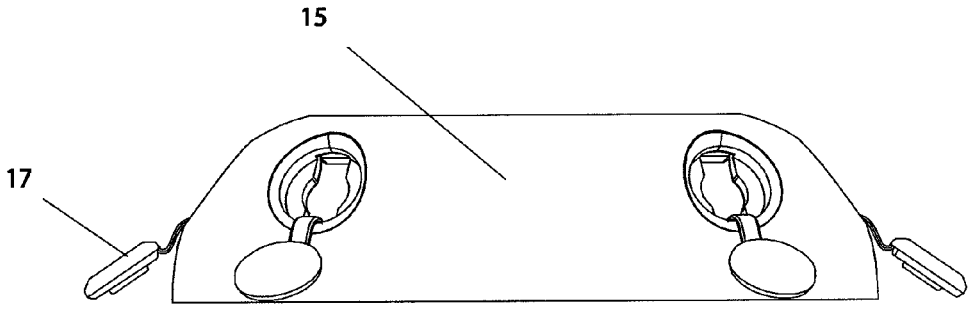
FIG. 20*a*-20*b* illustrates the cover and the caps.
Figure 20B:
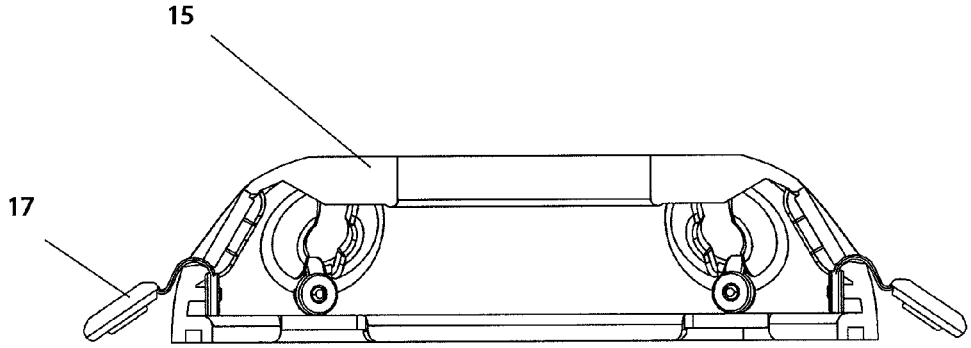

FIG. 20*a* shows a front view of the cover 15 with the caps 17 open. FIG. 20*b* shows a side view cross section of the cover 15 with the caps 17 open.

Embodiments of the invention have been described by way of example only. It will be appreciated that variations of the described embodiments may be made which are still within the scope of the invention.

For example, the nozzle can be used to produce fog, water or mist. Furthermore, gaseous or liquid fire suppressant materials can be used on there own or in combination and/or with water.

Features from the described arrangements may be used in combination with one another. For example, the arrangement of FIG. 5 could be used together with that of FIG. 6.

A single spray head can surround the base of a combination hot and cold tap.

The sink may include a drainboard and the spray head may be attached to the drainboard.

The fire suppression detection and/or initiation device(s) can comprise one or more of a rate of rise heat detector, push button, ionization smoke alarm, optical smoke alarm, UV flame detector or a combination fire alarm.

The alarm may also be connected to a phone line. The device may have a visual or audio alarm to notify when maintenance is due.

The arrangement may be such that an additional spray head is provided to spray under the sink around the pressure generator (e.g pump).

The spray head can be used with a variety of systems. For example, it could be used with a deluge system (where the valve opens, water flows through the pipe work and discharges simultaneously through all the nozzles in the system), a dry pipe system (where the pipe work is charged with air or inert gas under pressure), high, medium, or low pressure system, an object protection system (where water is designed to discharge directly on to an object or hazard (e.g. a fat fryer)), a pre action system (where it is triggered by a fire in another room it is there to protect spread to the kitchen), a water mist system (where the spray is 90% of the flow-weighted cumulative volumetric distribution of water droplets is less than 100 microns, a water spray system (in principle a tradition sprinkler), a wet pipe system (in which the pipe work is always charged water) and, in particular, a volume protection system (where the discharge of water mist is designed to protect all hazards in a predefined volume).

The invention claimed is:

1. A fire suppression spray head for attaching to an existing sink assembly comprising a sink and a tap, the spray head comprising a hub and having at least one nozzle for spraying fire suppressant material received from a supply of fire suppressant material, wherein the hub is configured to be retrofittably attached, as a separate fixture from the tap, around a base of the tap between the tap and the sink of the existing sink assembly.

2. The spray head according to claim 1, wherein the spray head is for use as part of a volume protection system.

3. The spray head according to claim 1, wherein the hub is configured to surround the base of the tap.

4. The spray head according to claim 1, wherein the hub comprises a threaded base portion for attaching to the sink.

5. The spray head according to claim 1, wherein the hub comprises an aperture on an upper surface for attaching to the base of a tap of an existing sink assembly.

6. The spray head according to claim 1, wherein the hub and at least one nozzle are arranged so that when attached to the sink assembly the nozzle can direct spray into the room that the sink is in.

7. The spray head according to claim 1, wherein the at least one nozzle is configurable on installation so that the fire suppressant material can be directed towards a fire load.

8. The spray head according to claim 1, wherein the at least one nozzle is on a separate, attachable component.

9. The spray head according to claim 1, wherein the hub comprises an aperture to allow one or more water supply pipes or hoses to pass through it for connection to a tap of an existing sink assembly.

10. The spray head according to claim 1, wherein the spray head comprises a pressure vessel for distributing flow to a number of nozzles.

11. The spray head according to claim 10, wherein the hub comprises an outer cover which mates with the pressure vessel.

12. The spray head according to claim 1, wherein the spray head comprises one or more protective nozzle caps and wherein the protective nozzle caps are held captively so that they stay connected to the spray head when open.

13. A kit comprising a spray head comprising a hub and having at least one nozzle for spraying fire suppressant material received from a supply of fire suppressant material, wherein the hub is configured to be retrofittably attached around a base of a tap, as a separate fixture from the tap, between the tap and a sink of an existing sink assembly and a pressure generator for pressurizing the fire suppressant material.

14. The kit according to claim 13, further comprising one or more pipes or supply hoses, and a fire suppression and/or initiation device(s).

15. A fire suppression system, the system comprising a spray head comprising a hub and having at least one nozzle for spraying fire suppressant material received from a supply of fire suppressant material, wherein the hub is configured to be retrofittably attached around a base of a tap, as a separate fixture from the tap, between the tap and a sink of an existing sink assembly, the hub connected to a supply of fire suppressant material, and a fire suppression and/or initiation device(s) which, when activated, causes fire suppressant material to spray out of the at least one nozzle of the spray head, the system further comprising a pressure generator arranged to generate pressure to spray the fire suppressant material out of the at least one nozzle.

16. The fire suppression system according to claim 15, wherein the fire suppression system is a volume protection system.

17. The fire suppression system according to claim 15, wherein the system is arranged to produce a spray in which 90% of the flow weighted cumulative volumetric distribution of water droplets is less than 100 microns.

18. A method of installing a spray head to an existing sink assembly comprising a tap and a sink, the spray head comprising a hub and having at least one nozzle for spraying fire suppressant material received from a supply of fire suppressant material, the method comprising retrofittably attaching the hub, as a separate fixture from the tap, around a base of the tap between the tap and the sink of the existing sink assembly and connecting the spray head to a pressure generator arranged to generate pressure to spray fire suppressant material out of the at least one nozzle.

19. The method according to claim 18, further comprising configuring the spray head to direct different spray patterns to different fire loads.

* * * * *